United States Patent [19]

Beckwith

[11] 4,082,927

[45] Apr. 4, 1978

[54] ELECTRICAL MAGNETIC SWITCH ADAPTABLE FOR USE IN DIGITAL WRISTWATCHES

[76] Inventor: John R. Beckwith, 480 Lassen St., Los Altos, Calif. 94022

[21] Appl. No.: 725,386

[22] Filed: Sep. 22, 1976

[51] Int. Cl.[2] ..... H01H 35/14; G04B 19/30; G04C 23/10

[52] U.S. Cl. ..... 200/52 R; 58/23 R; 58/50 R; 58/85.5; 58/88 R; 200/61.45 M; 200/61.53; 335/280

[58] Field of Search ..... 58/23 R, 23 BA, 50 R, 58/88 R; 200/61.45 R, 61.45 M, 61.48-61.53, 52 R; 335/205, 206, 280

[56] References Cited

U.S. PATENT DOCUMENTS

| | | | |
|---|---|---|---|
| 2,015,156 | 9/1935 | Richmond | 335/280 |
| 2,890,303 | 6/1959 | Clurman | 340/262 X |
| 2,898,415 | 8/1959 | Clurman | 200/61.53 X |
| 2,997,557 | 8/1961 | Gillmor et al. | 200/61.45 M |
| 3,171,913 | 3/1965 | Kersh | 200/61.53 |
| 3,459,911 | 8/1969 | Fischer | 335/205 X |
| 3,946,173 | 3/1976 | Haber | 200/52 R |
| 3,975,899 | 8/1976 | Haber | 58/88 R |

*Primary Examiner*—James R. Scott
*Attorney, Agent, or Firm*—Jack M. Wiseman

[57] ABSTRACT

An electrical magnetic switch adaptable for use in a digital wristwatch in which a command function for a digital wristwatch is controlled by a switch or an actuator. The magnetic switch is normally open and is closed by the movement of the wrist of the wearer to overcome the magnetic force from a permanent magnet on a magnetizable movable armature. The displacement of the magnetizable movable armature against the urgency of the magnetic force closes a circuit for performing a command function for the digital wristwatch. For regulating the magnitude of force on which the magnetizable movable armature is displaced against the urgency of the magnetic force of the permanent magnet, means are provided for adjustably positioning the permanent magnet relative to the path of travel of the magnetizabe movable armature. Alternatively, the movable armature may be a permanent magnet and the adjustably positioned means may be made of magnetizable material.

22 Claims, 13 Drawing Figures

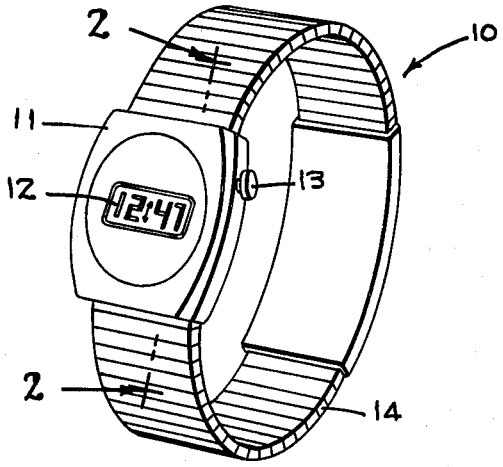
Fig-1
Fig-2
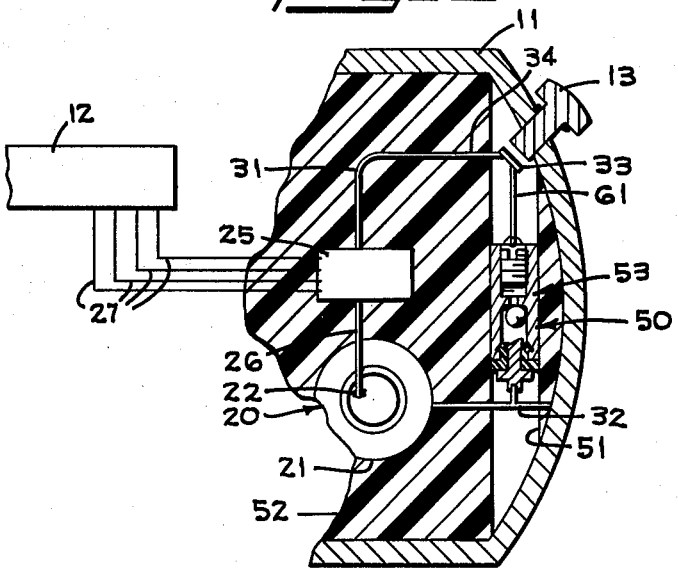

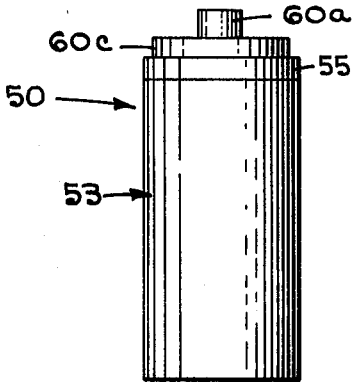
Fig-7
Fig-8
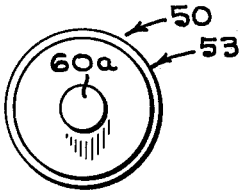
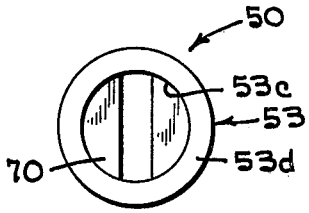
Fig-9
Fig-10
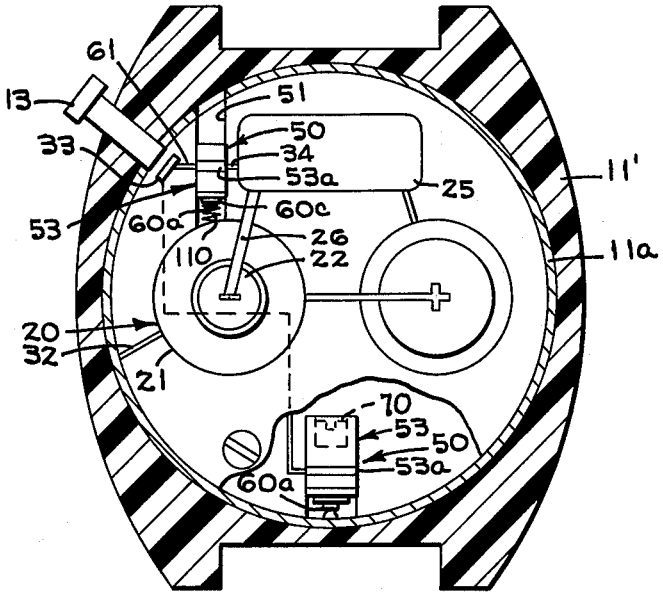
Fig-11
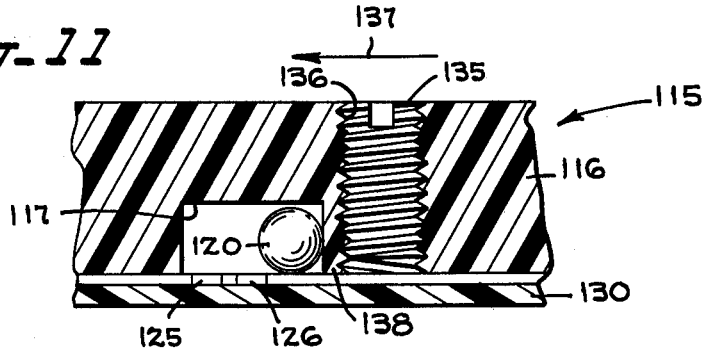

ELECTRICAL MAGNETIC SWITCH ADAPTABLE FOR USE IN DIGITAL WRISTWATCHES

BACKGROUND OF THE INVENTION

The present invention relates in general to an electrical magnetic switch, and more particularly to an electrical magnetic switch adaptable for use in a digital wristwatch.

In the U.S. Pat. to Haber, No. 3,911,666, issued on Oct. 14, 1975, for Actuating Mechanisms For Wrist Instruments, there is disclosed a digital wristwatch in which a movable contact is moved by the movement of the wrist of the wearer of the wristwatch against the urgency of gravity or inertia to close a circuit for illuminating or activating the digital display of a digital wristwatch.

On Mar. 23, 1976, U.S. Pat. No. 3,946,173 issued to the same inventor for Acceleration/Deceleration Actuating Mechanisms For Wrist Instruments in which is disclosed a digital wristwatch having a movable contact displaceable by the movement of the wrist of the wearer of the wristwatch against the urgency of the magnetic force of a permanent magnet to close a circuit for making visible the digital display of a digital wristwatch.

On June 13, 1963, the applicant of the present application filed an application, U.S. Ser. No. 287,681, for a Ball Armature Microminiature Relay Energized by Electromagnetic Means. This application had been abandoned. The just-mentioned application disclosed a microminiature relay in which a raceway had a set of contacts disposed therein. A spherical armature was disposed in the raceway and movable therein. An electromagnet created a magnetic field for drawing the spherical armature into engagement with the set of contacts in the raceway for establishing an electrical contact. Of interest in this regard are the U.S. Pat. to Ohl, No. 2,732,464 and the U.S. Pat. to Irwin et al., No. 2,369,296. A patent to Buckingham, No. 2,732,458 shows an arrangement for adjusting the position of abutting ends of magnets relative to a contact assembly. The patent to Richmond, No. 2,015,156 discloses an arrangement for adjusting the position of a chamber with respect to an electromagnetic coil.

The digital wristwatches heretofore illuminable or made visible by the movement of the wrist of the wearer of the wristwatch were not adjustable to accommodate the preference of the wearer, the aging of the permanent magnet, the magnetic environment of the watch case, or the elements therein contained. The magnetizable elements in the wristwatch may influence the magnetic fields of the electrical magnetic switch.

SUMMARY OF THE INVENTION

An electrical magnetic switch comprising a movable armature which is displaceable by movement of the user against the urgency of magnetic attraction to activate a circuit. Means are provided for adjustably positioning a magnetic force-implementing member relative to the path of travel of the movable armature to regulate the force required for the displacement thereof against the urgency of the magnetic forces.

By virtue of the present invention, digital wristwatches employing the electrical magnetic switch of the present invention can be adjusted so that the force of movement of the wrist of the wearer required to illuminate or make visible the digital display of the wristwatch can be regulated. In so doing, the action can be regulated to accommodate the preference of the wearer, the aging of the permanent magnet, the magnetic environment of the watch case, and the elements therein contained. Thus, the manufacturer and the wearer can select the magnetic force required for the actuation of the switch and accommodate the preference of the individual wearer.

DESCRIPTION OF THE DRAWINGS

FIG. 1 is a perspective view of a digital wristwatch incorporating the present invention.

FIG. 2 is an enlarged fragmentary sectional view taken along line 2—2 of FIG. 1.

FIG. 7 is an elevation view of the electrical magnetic switch shown in FIGS. 3 and 4.

FIG. 8 is an end view of the contact end of the electrical magnetic switch shown in FIGS. 3, 4 and 7.

FIG. 9 is an end view of the adjustment end of the electrical magnetic switch shown in FIGS. 3, 4, 7 and 8.

FIG. 10 is a bottom view of a modification of the digital wristwatch shown in FIGS. 1 and 2 with the cover thereof removed.

FIG. 11 is a diagrammatic view of a further modification of an electrical magnetic switch embodying the present invention.

DESCRIPTION OF THE PREFERRED EMBODIMENTS

Figure 4:
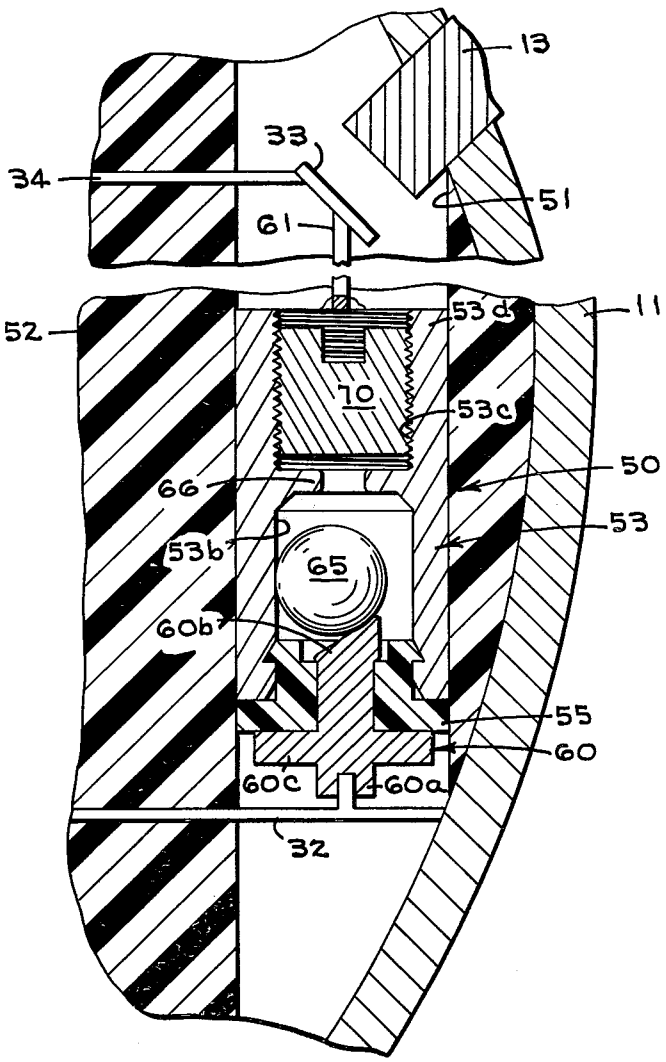
FIG. 4 is an enlarged fragmentary sectional view similar to FIG. 2 to illustrate the electrical magnetic switch shown in FIG. 3 in a closed position.

Illustrated in FIG. 1 is a digital wristwatch 10 comprising a case 11. The case 11 is made of suitable conducting material. Should it be desired to make the case 11 of plastic, then a suitable conductor, such as a metallic lining, is disposed along the inner wall of the case 11. Additionally, the digital wristwatch 10, in the exemplary embodiment, includes a well-known and conventional digital display 12. Other well-known common functions can be employed equally as well. For example, seconds display, minutes display, hour display, day display, data display, time zone display, timing stopwatch display, and the like. The digital display 12 may be either light-emitting diodes or liquid crystal display. If it is a liquid crystal display, then illuminating means could be provided to make the display adequately visible in the darkness. If the digital display comprises light-emitting diodes, then the power source is applied thereto at selected intermittent times to avoid excessive power drain. Likewise, when the digital display is a liquid crystal display, the illumination thereof is selective and intermittent to avoid excessive power drain.

It is conventional to employ a push button or a command actuator, such as push button 13, for manually closing a circuit for the illumination or to make visible the digital display 12 of the wristwatch 10. Also, a circuit could be closed to perform other well-known command functions, such as the command of seconds, date, or any other available function. The wristwatch 10 is retained on the wrist of the wearer through a suitable watchband 14. The push button 13 is in constant electrical and mechanical engagement with the case 11 (FIG. 2).

Disposed with the casing 11 is a suitable source of power or battery 20 (FIG. 2). The battery 20 has two terminals, namely: an outer terminal 21 and an inner terminal 22. In the example shown, the inner terminal 22 is connected to a conventional timing and driving integrated circuit 25 over a conductor 26 which is also disposed within the casing 11. Within the digital display 12 are either light-emitting diodes or a liquid crystal display that is made visible or illuminated, as the case may be, by the integrated circuit 25. The circuit 25 is connected by conductors 27 to display 12. In the example shown, the outer terminal 21 of the battery 20 is connected over a conductor 32 to the case 11. The circuit 25 is connected to a contact 33 over a conductor 34. The contact 33 is disposed in the path of travel of the stem of the push button or command actuator 13. Thus, the depression of the push button 13 causing the stem thereof to engage the contact 33 activates the circuit 30 over the following path: terminal 22 of the battery 20, conductor 26, electronic timing circuit 25, conductor 34, contact 33, push button 13, case 11, conductor 32, and outer terminal 21 of the battery 20.

According to the present invention, an electrical magnetic switch 50 (FIGS. 2, 3, 4 and 7–9) may also be employed to activate the circuit 25 or other well-known command function circuits. Toward this end, the electrical magnetic switch 50 is disposed in a recess 51 (FIGS. 2–4) formed in an insulator 52 that is disposed in the casing 11. In a similar manner, the battery 20 (FIG. 2) and electronic timing circuit 25 are disposed in wells or recesses of the insulator 52. The contact 33 (FIGS. 2–4) is disposed in the recess 51.

Figure 3:
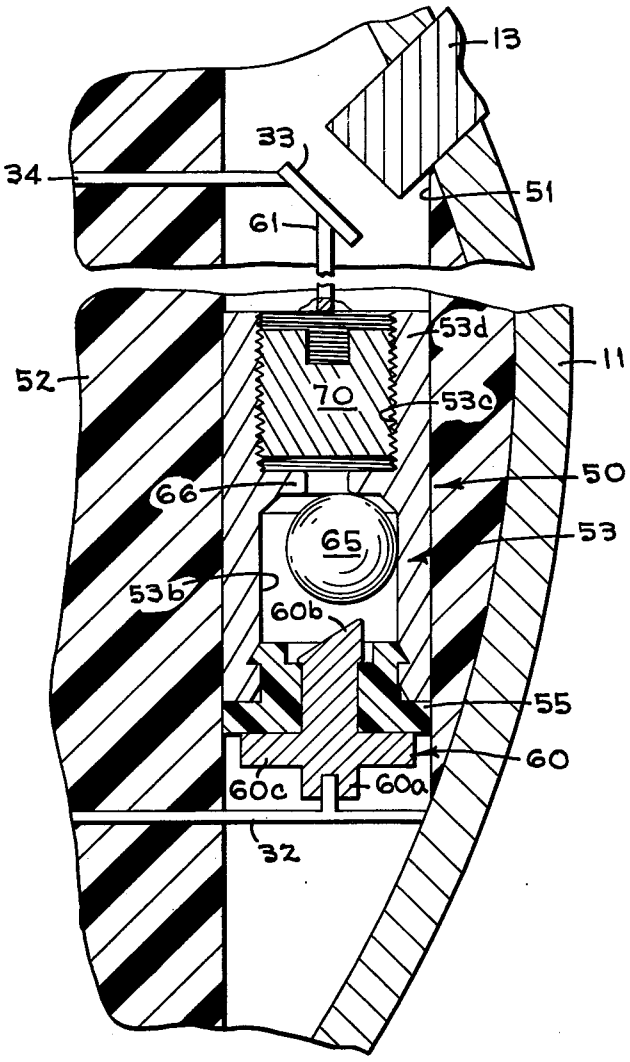
FIG. 3 is an enlarged fragmentary sectional view similar to FIG. 2 to illustrate an electrical magnetic switch embodying the present invention and shown in an open position.

The electrical magnetic switch 50 comprises a fixed cylindrical contact 53 (FIGS. 2, 3, 4 and 7–9) made of suitable electrically conducting material. In the exemplary embodiment, the fixed cylindrical contact 53 is made of brass with a gold over nickel outer layer or other suitable contact material. At one end of the fixed cylindrical contact 53 (FIGS. 2, 3 and 4) is fixed a sleeve insulator 55 which, in the exemplary embodiment, is made of natural nylon. Disposed within the sleeve insulator 55 is a fixed contact 60 of suitable electrically conducting material. The fixed contact 60, in the preferred embodiment, is made of brass with an external layer of gold over nickel. The fixed contact 60 includes a terminal **60*a* (FIGS. 3, 4 and 8) that projects into the fixed cylindrical contact 53 beyond the sleeve insulator 55. The free end of the terminal 60*a* has an angularly disposed guide surface 60*b* (FIGS. 3 and 4). Additionally, the fixed contact 60 has a base 60*c* that abuts against the sleeve insulator 55**.

A conductor 61, which could be conductive epoxy or solder, connects the cylindrical contact 53 to the contact 33. The conductor 32 serves to electrically connect the fixed contact 60 to the outer terminal 21 of the battery 20 and to the outer case 11. Formed within the fixed cylindrical contact 53 is a cylindrical bore **53*b* in which is disposed a spherical movable armature 65 of electrically conducting material. In the preferred embodiment, the spherical movable armature 65 is made of steel and has an outer layer of gold over nickel. The spherical movable armature 65 is freely movable within the bore 53*b*. A radially extending stop 66 of frustoconical configuration limits the movement of the spherical movable armature 65 in a direction away from the free end of the stem 60*a* of the fixed contact 60**.

Also formed in the fixed cylindrical contact 53 is a bore **53*c* surrounded by a threaded wall 53*d*. Disposed in threaded engagement with the wall 53*d* is a threaded cylindrical permanent magnet 70. The outer wall of the cylindrical permanent magnet 70 is threaded for threaded engagement with the inner wall 53*d* of the fixed contact 53**. While a threaded arrangement is shown in the preferred embodiment, other well-known arrangements may be employed for relative adjustable settings.

By means of a suitable turning implement, the position of the permanent magnet 70 in the bore **53*c* can be adjusted toward or away from the bore 53*b* in which travels the spherical movable armature 65. The permanent magnet 70**, in the exemplary embodiment, is made of suitable material, such as a combination of copper, nickel and iron.

Normally, the movable spherical armature 65 is disposed against the stop 66 (FIG. 3) under the urgency of the magnetic force or attraction of the permanent magnet 70. When the wearer of the wristwatch 10 moves his wrist in the axial direction of the fixed cylindrical contact 53 against the urgency of the magnetic force or magnetic attraction of the permanent magnet 70, the spherical movable armature 65 travels away from the permanent magnet 70 to abut against the terminal **60*a* of the fixed contact 60 temporarily and is guided by the angularly disposed surface 60*b* to engage temporarily both the fixed contact 60 and the fixed cylindrical contact 53** (FIG. 4).

When the movable spherical armature 65 is in its normal position disposed against the stop 66 (FIG. 3), the circuit 25 is not activated. When the movable spherical armature 65 is moved temporarily into engagement with both the fixed contact 60 and the fixed contact 53 (FIG. 4), the circuit 25 is activated over the following path: fixed contact 60, conductor 32, outer terminal 21 of the battery 20, inner terminal 22 of the battery 20, conductor 26, electronic timing circuit 25, conductor 34, contact 33, conductor 61, fixed contact 53, and movable spherical armature 65. More specifically, this operation serves to energize any circuit that would be energized by the actuation of the command actuator 13.

It is apparent that the movable armature 65 could be of a cylindrical configuration. Additionally, the movable armature of conducting material could be the permanent magnet, while the adjustably positioned member could be of magnetizable material, such as iron or steel.

Additionally, the present invention contemplates that the casing 11 could be made of a suitable nonmetallic material, such as plastic, in which event the push button 13 would be in direct contact with a metallic lining along the inner wall of the casing 11, and the conductor 32 would be directly connected to the metallic lining of the casing 11.

Figure 6:
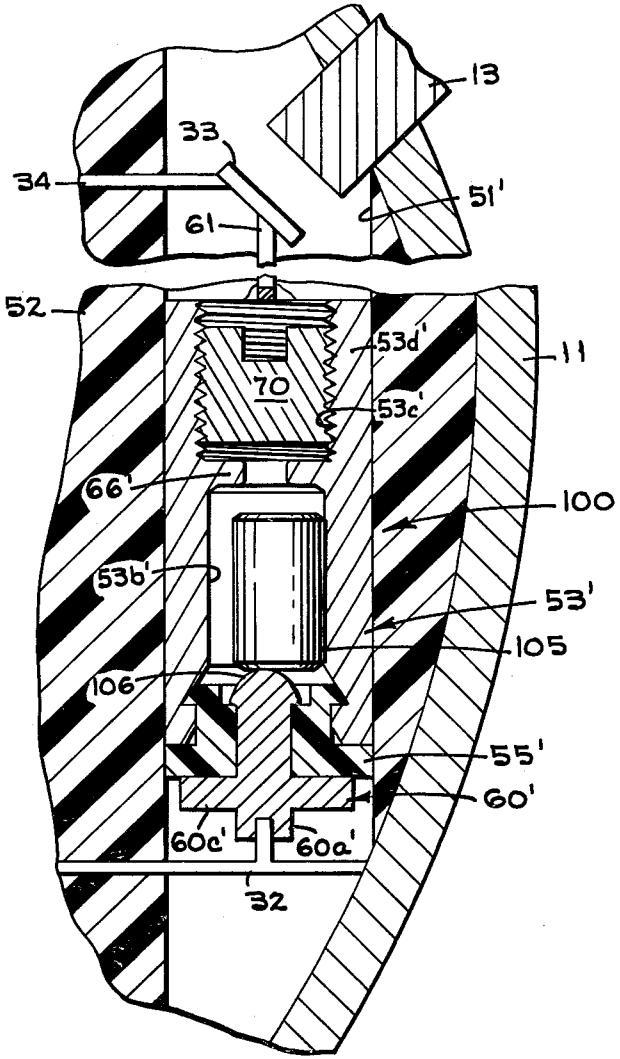
FIG. 6 is a view similar to FIG. 4 and illustrates the electrical magnetic switch shown in FIG. 5 in the closed position.
Figure 5:
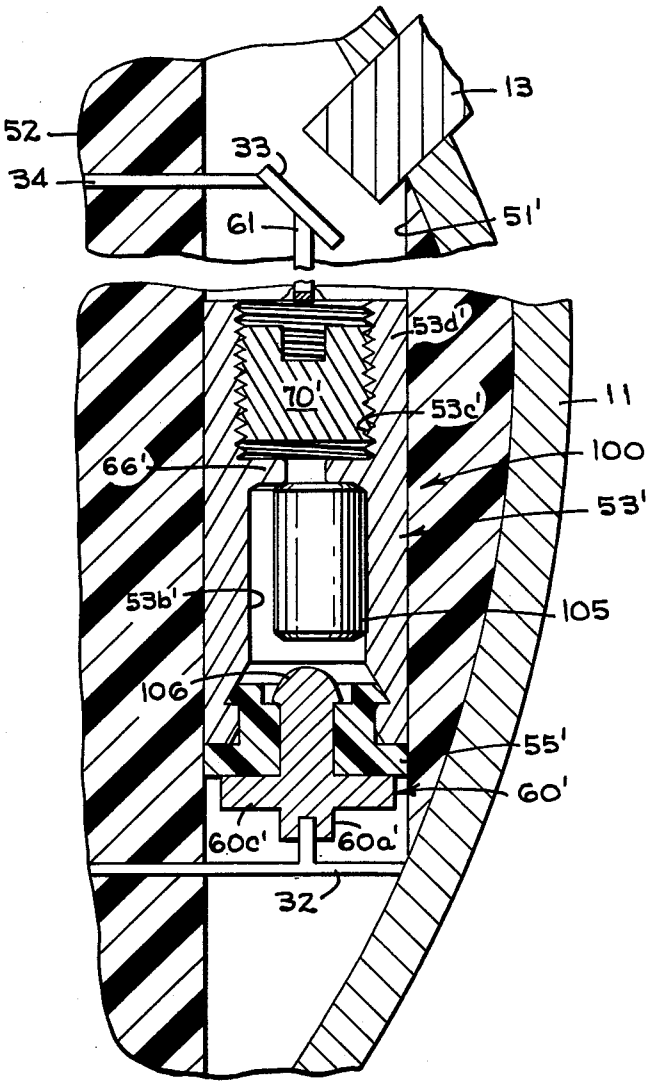
FIG. 5 is a view similar to FIG. 3 and illustrates a modification of the electrical magnetic switch shown in FIGS. 3 and 4, and shown in the open position.

Illustrated in FIGS. 5 and 6 is an electrical magnetic switch 100 which is a modification of the magnetic switch 50 shown in FIGS. 3 and 4. Parts of the magnetic switch 100 similar to the magnetic switch 50 are shown with the same reference numeral and having a prime suffix. In the magnetic switch 100, a movable armature 105 is employed, which has a cylindrical configuration and is made of suitable electrically conducting material. In the exemplary embodiment, the armature 105 is a permanent magnet and is made of a combination of copper, nickel and iron with an outer layer of gold over nickel. The free end 106 of the terminal 60*a'* of the fixed contact 60' has a rounded or substantially hemispherical configuration.

An adjustably positioned member 70' is disposed in the bore 53*c'* with a threaded outer wall 53*d'*. The adjustably positioned member 70' is made of magnetizable material which, in the exemplary embodiment, is steel or iron.

Normally, the movable cylindrical armature 105 is disposed against the stop 66' (FIG. 5) under the urgency of the magnetic force or attraction created by the permanent magnet cylindrical armature 105 and the adjustably positioned member 70'. When the wearer of the wristwatch 10 moves his wrist in the axial direction of the fixed cylindrical contact 53' against the urgency of the magnetic force or magnetic attraction of the permanent magnet armature 105 with the adjustably positioned member 70', the movable cylindrical armature 105 travels along the wall of the bore 53*b'* toward the terminal 60*a'* of the fixed contact 60' into engagement with the free end 106 thereof (FIG. 6). Thus, the cylindrical armature 105 is in contact with the inner wall of the fixed contact 53' and the free end 106 of the fixed contact 60'.

When the movable cylindrical armature 105 is in its normal position disposed against the stop 66' (FIG. 5), the circuit 25 is not activated. When the movable cylindrical armature 105 is intermittently moved into engagement with both the fixed contact 60' and the fixed contact 53' (FIG. 6), the circuit 25 is activated over the following path: fixed contact 60', conductor 32, outer terminal 21 of the battery 20, inner terminal 22 of the battery 20, conductor 26, electronic timing circuit 25, conductor 34, contact 33, conductor 61, fixed contact 53', and movable cylindrical armature 105. More specifically, this operation serves to energize any circuit that would be energized by the actuation of the command actuator 13.

Illustrated in FIG. 10 is another application of the electrical magnetic switch 50 within a conventional digital wristwatch. In this instance, the contact end 60*a* of the fixed contact 60 makes an electrical contact with the outer terminal 21 of the battery 20 through a spring 110. The cylindrical fixed contact 53, through a conductive epoxy or solder ring 53*a*, is connected to the conductor 61. The conductor 32 is electrically connected to a metallic conductor lining 11*a* for the plastic case 11. The contact 33 is connected to the conductor 34 for establishing an electrical connection with a common performing circuit.

Also illustrated in FIG. 10 is another application of the electrical switch 50 within a conventional digital wristwatch. In this instance, the fixed cylindrical contact 53, through the conductive epoxy or solder ring 53*a*, is connected directly to substrate traces of a semiconductor substrate circuit embodied in the case 11' for the activation of a command performing circuit.

In FIG. 11 is shown a further modification 115 of the electrical magnetic switch 50 which comprises a plastic case or housing 116. Formed in the housing 116 is a suitable raceway 117. Disposed in the raceway 117 is a movable spherical armature 120 of magnetic material. Facing the raceway 117 are fixed contacts 125 and 126, which adhere to a substrate circuit or printed board, such as substrate 130. At the other end of the raceway 117, a cylindrical magnetizable member 135 is disposed within a bore 136 formed in the housing 116. The outer wall of the cylindrical magnetizable member 135 is in threaded engagement with the wall surrounding the bore 136.

By means of a suitable turning implement, the position of the cylindrical magnetizable member 135 can be retracted from the raceway 117 or moved deeper into the raceway 117 for adjusting the magnetic force between the spherical movable armature 120 and the cylindrical magnetizable member 135.

Normally, the movable spherical armature 120 is against an insulator stop 138 and adjacent the magnetizable member 135 under the urgency of the magnetic force therebetween. An operator applying a manual force to the spherical armature 120 against the urgency of the magnetic force or magnetic attraction between the armature 120 and the member 135 in the direction of an arrow 137 moves the spherical armature 120 away from the magnetizable member 135 and into temporary contact with both of the fixed contacts 125 and 126 to activate a suitable circuit on the substrate 130 to effect a command.

It is apparent that the spherical armature 120 could be made of magnetizable material and the cylindrical member 135 could be a permanent magnet.

Figure 12:
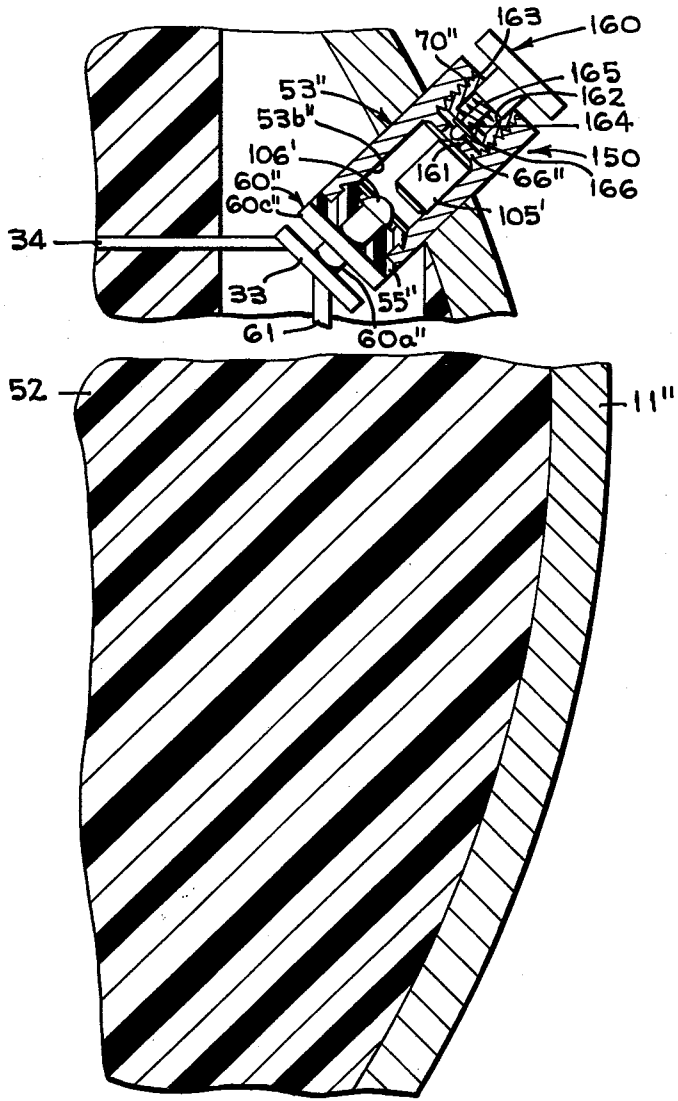
FIG. 12 is a diagrammatic view of a further modification of an electrical magnetic switch embodying the present invention in the form of a combination switch-actuator.

In FIG. 12 is illustrated an electrical magnetic switch and actuator 150, which is a modification of the electrical magnetic switch 100 shown in FIGS. 5 and 6. Therefore, elements in the electrical magnetic switch and actuator 150 similar to the electrical magnetic switch 100 have been designated with the same reference numeral, but having an added prime suffix.

The movable armature 105' is not only actuated by magnetic forces as previously described in connection with FIGS. 5 and 6 but, also, is actuated by a manually operated cylindrical plunger 160. The plunger 160 may be a push button, such as the push button 13 of FIGS. 1–6. Toward this end, the stop 66'' is formed with a central cylindrical opening 161 and the adjustably positioned member 70'' is formed with a central cylindrical opening 162 and an increased diameter central cylindrical opening 163. Movable within the central opening 161 is a cylindrical actuator 164 of the plunger 160.

The plunger 160 is movable within the opening 162 and has its axially disposed actuator 164 movable within the opening 161. A suitable spring 165 is seated in the central opening 162 and continuously urges the plunger 160 and the actuator 164 in a direction away from the movable armature 105'. Thus, an operator desiring to move the movable armature 105' temporarily into engagement with the fixed contact 60'' actuates the plunger 160 against the urgency of the spring 165 toward the fixed contact 60''. When the operator releases the plunger 160, the spring 165 returns the plunger 160 and the actuator 164 to their initial position. A stop 166 fixed to the actuator 164 limits the movement of the plunger 160 under the urgency of the spring 165.

Figure 13:
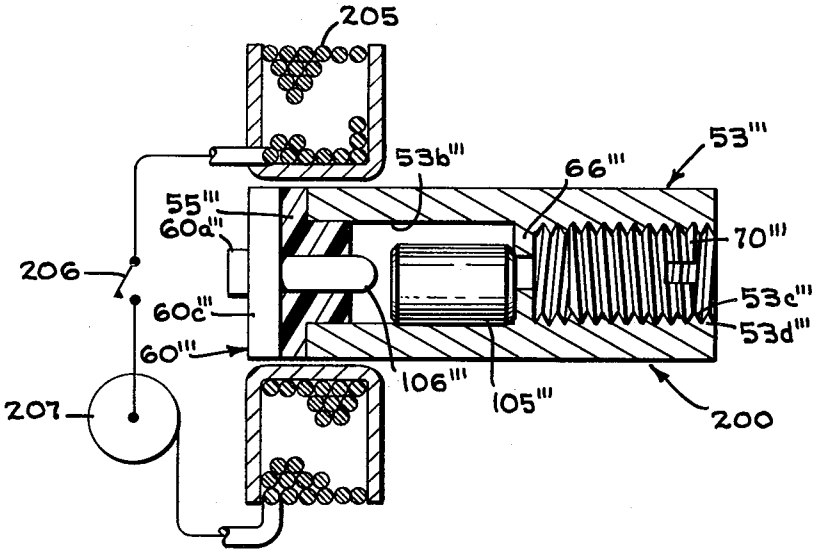
FIG. 13 is a diagrammatic view of a further modification of an electrical magnetic switch embodying the present invention.

Illustrated in FIG. 13 is an electrical magnetic switch 200, which is a modification of the electrical magnetic switch 100 shown in FIGS. 5 and 6. Therefore, elements in the electrical magnetic switch 200 similar to the electrical magnetic switch 100 have been designated with the same reference numeral, but having an added double prime suffix. The electrical magnetic switch 200 is not only actuated by magnetic forces as previously described in connection with FIGS. 5 and 6, but also is actuated by a magnetic field produced by the energization of a magnetic coil 205. The magnetic coil 205 is wound around the contact end of the electrical magnetic switch 200 and is energized by any suitable circuit through the closing of a suitable switch. In the exemplary embodiment, the coil 205 is energized by the closing of switch 206 to complete a circuit through a battery 207.

The energization of the coil 205 produces a magnetic field of sufficient strength to move the movable armature 105″ into engagement with the contact end 106″ of the fixed contact 60‴ against the urgency of the magnetic forces between the movable armature 105″ and the adjustably positioned member 70‴. The opening of the switch 206 deenergizes the coil 205 and the movable armature 105″ is returned to its initial position under the urgency of the magnetic forces between the movable armature 105″ and the adjustably positioned member 70‴.

I claim:

1. An electrical magnetic switch comprising:

(a) a first fixed electrical contact formed with a first and second bore therein disposed in longitudinally spaced relation;

(b) a second fixed electrical contact disposed adjacent to one end of said bore of said first fixed contact with a portion thereof extending into said bore;

(c) insulating means interposed between said second fixed contact and said first fixed contact;

(d) a movable armature disposed in said first bore for movement between a first position spaced from said portion of said second fixed contact and a second position in contact with both said portion of said second fixed contact and said first fixed contact to establish an electrical connection therebetween via said armature;

(e) magnetic attraction means in said second bore of said first fixed contact for providing a magnetic force with said movable armature for normally retaining said movable armature in said first position, the movement of said movable armature against the urgency of the magnetic force into engagement with said portion of said second fixed contact and said first fixed contact establishes an electrical connection therebetween via said armature; and (f) means interengaging said first fixed contact and said magnetic attraction means for adjustably positioning said magnetic attraction means in said second bore relative to the path of travel of said movable armature for regulating the magnetic forces between said magnetic attraction means and said movable armature.

2. An electrical magnetic switch as claimed in claim 1 wherein said movable armature has a spherical configuration.

3. An electrical magnetic switch as claimed in claim 2 wherein said portion of said second fixed contact is contoured to guide said movable armature into engagement with both said portion of said second fixed contact and said first fixed contact in response to said movable armature advancing toward said second position.

4. An electrical magnetic switch as claimed in claim 2 wherein said magnetic attraction means has a cylindrical configuration with a threaded outer wall, and wherein said second bore is surrounded by a threaded wall, said magnetic attraction means being in threaded engagement with said wall surrounding said second bore for adjustably positioning said magnetic attraction means relative to the path of travel of said movable armature.

5. An electrical magnetic switch as claimed in claim 2 wherein said magnetic attraction means is a permanent magnet and said movable armature is made of magnetizable material.

6. An electrical magnetic switch as claimed in claim 2 wherein said movable armature is a permanent magnet and said magnetic attraction means is made of magnetizable material.

7. An electrical magnetic switch as claimed in claim 1 wherein said movable armature has a cylindrical configuration.

8. An electrical magnetic switch as claimed in claim 7 wherein said magnetic attraction means has a cylindrical configuration with a threaded outer wall, and wherein said second bore is surrounded by a threaded wall, said magnetic attraction means being in threaded engagement with said wall surrounding said second bore for adjustably positioning said magnetic attraction means relative to the path of travel of said movable armature.

9. An electrical magnetic switch as claimed in claim 7 wherein said magnetic attraction means is a permanent magnet and said movable armature is made of magnetizable material.

10. An electrical magnetic switch as claimed in claim 7 wherein said movable armature is a permanent magnet and said magnetic attraction means is made of magnetizable material.

11. An electrical magnetic switch as claimed in claim 1 and comprising an electrically conductive spring disposed in engagement with said second fixed contact for establishing an electrical connection.

12. An electrical magnetic switch as claimed in claim 1 and comprising a conductor on the outer wall of said first fixed contact for establishing an electrical connection.

13. An electrical magnetic switch as claimed in claim 12 and comprising a substrate with substrate traces and wherein said conductor on the outer wall of said first fixed contact contacts said substrate traces for establishing the electrical connection.

14. An electrical magnetic switch as claimed in claim 1 wherein said magnetic attraction means has a cylindrical configuration with a threaded outer wall, and wherein said second bore is surrounded by a threaded wall, said magnetic attraction means being in threaded engagement with said wall surrounding said second bore for adjustably positioning said magnetic attraction means in said second bore relative to the path of travel of said movable armature.

15. An electrical magnetic switch as claimed in claim 1 and comprising a magnetic coil surrounding said second fixed contact, and means for energizing said coil for moving said movable armature against the urgency of the magnetic force between said movable armature and said magnetic attraction means into engagement with said portion of said second fixed contact and said first fixed contact to establish an electrical connection therebetween.

16. An electrical magnetic switch comprising:

(a) a housing of non-conductive material formed with a bore therein;

(b) a raceway formed in said housing;

(c) a movable armature movable within said housing;

(d) a semiconductor substrate having a pair of spaced fixed electrical contacts therein confronting said raceway and disposed in the path of travel of said movable armature, said fixed contacts being aligned in the direction of travel of said armature;

(e) magnetic attraction means disposed in said bore of said housing adjacent to said raceway to provide a magnetic force with said movable armature for normally retaining said novable armature from engagement with said fixed contacts, the movement of said movable armature against the urgency of said magnetic force moves said movable armature into engagement with said fixed contacts for establishing an electrical connection therebetween via said armature; and (f) means interengaging said housing and said magnetic attraction means for adjustably positioning said magnetic attraction means relative to said raceway for regulating the magnetic forces between said magnetic attraction means and said movable armature.

17. An electrical magnetic switch as claimed in claim 16 wherein said movable armature has a spherical configuration.

18. An electrical magnetic switch as claimed in claim 17 wherein said movable armature is a permanent magnet and said magnetic attraction means is made of magnetizable material.

19. An electrical magnetic switch as claimed in claim 17 wherein said movable armature is made of magnetizable material and said magnetic attraction means is a permanent magnet.

20. An electrical magnetic switch as claimed in claim 16 wherein said magnetic attraction means has a cylindrical configuration with a threaded outer wall, and wherein said bore in said housing is surrounded by a threaded wall, said magnetic attraction means being in threaded engagement with said wall surrounding said bore for adjustably positioning said magnetic attraction means relative to said raceway.

21. An electrical magnetic switch as claimed in claim 16 wherein said fixed contacts on said substrate are made of a conductive material adhering to said substrate.

22. An electrical magnetic switch comprising:

(a) a first fixed contact formed with a first and second bore therein disposed in longitudinally spaced relation;

(b) a second fixed contact disposed adjacent to one end of said first bore of said first fixed contact with a portion thereof extending into said first bore;

(c) insulating means interposed between said second fixed contact and said first fixed contact;

(d) a movable armature disposed in said first bore for movement between a first position spaced from said portion of said second fixed contact and a second position in contact with both said portion of said second fixed contact amd said first fixed contact to establish an electrical connection therebetween;

(e) magnetic attraction means in said second bore of said first fixed contact for providing a magnetic force with said movable armature for retaining said movable armature in said first position, the movement of said movable armature against the urgency of the magnetic force into engagement with said portion of said second fixed contact and said first fixed contact establishes an electrical connection therebetween, said magnetic attraction means having a cylindrical configuration with a threaded outer wall, said second bore being surrounded by a threaded wall, said magnetic attraction means being in threaded engagement with said wall surrounding said second bore for adjustably positioning said magnetic attraction means in said second bore relative to the path of travel of said movable armature, a central opening formed in said magnetic attraction means communicating with said first bore;

(f) a plunger seated in said central opening formed in said magnetic attraction means, said plunger being formed with an actuator for engaging said movable armature;

(g) a spring disposed in said central opening of said magnetic attraction means between said plunger and said magnetic attraction means, said spring urging said plunger in a direction to move said actuator away from said movable armature, said plunger being movable against the urgency of said spring for said actuator to move said movable armature into said second position; and (h) means interengaging said first fixed contact and said magnetic attraction means for adjustably positioning said magnetic attraction means in said second bore relative to the path of travel of said movable armature for regulating the magnetic forces between said magnetic attraction means and said movable armature.

* * * * *